US006142527A

United States Patent [19]

Lenhart

[11] Patent Number: 6,142,527

[45] Date of Patent: Nov. 7, 2000

[54] SKI OR WALKING STICK WITH ADJUSTABLE HANDLE

[76] Inventor: Klaus Lenhart, Mittlerer Weg 23, D-73230 Ohmden, Germany

[21] Appl. No.: 09/147,802

[22] PCT Filed: Sep. 9, 1997

[86] PCT No.: PCT/EP97/04901

§ 371 Date: Mar. 11, 1999

§ 102(e) Date: Mar. 11, 1999

[87] PCT Pub. No.: WO98/10845

PCT Pub. Date: Mar. 19, 1998

[30] Foreign Application Priority Data

Sep. 11, 1996 [DE] Germany ..... 196 42 297

[51] Int. Cl.[7] ..... A63C 11/00

[52] U.S. Cl. ..... 280/823; 135/74

[58] Field of Search ..... 280/819, 821, 280/823; 135/65, 66, 74, 75

[56] References Cited

U.S. PATENT DOCUMENTS

| | | | |
|---|---|---|---|
| 4,229,016 | 10/1980 | Wolf | 280/821 |
| 4,596,405 | 6/1986 | Jones | 280/823 |
| 4,597,589 | 7/1986 | Fujii et al. | 280/821 |
| 5,139,283 | 8/1992 | Dow et al. | 280/819 |
| 5,287,870 | 2/1994 | Rhodes . | |
| 5,538,354 | 7/1996 | Simond | 280/819 X |

FOREIGN PATENT DOCUMENTS

| | | |
|---|---|---|
| 0081439A2 | 6/1983 | European Pat. Off. . |
| 504878 | 8/1930 | Germany . |
| 2204217 | 4/1976 | Germany . |
| 8702756 | 4/1987 | Germany . |
| 4440343A1 | 5/1996 | Germany . |

*Primary Examiner*—Brian L. Johnson
*Assistant Examiner*—Bryan Fischmann
*Attorney, Agent, or Firm*—Jones, Tullar & Cooper, P.C.

[57] ABSTRACT

The invention concerns a A stick such as a ski pole, a walking stick or the like, which has a pole grip and a pole tube, the length of which can be altered, as well as an adjusting device with which at least one gripping area of the stick pole grip can be adjusted in a bent position relative to the pole tube. The purpose of the invention is to obtain a stick which can be folded into a compact unit as small as possible. To this end the pole tube has two sections joined together by the adjusting device and the adjusting device is accommodated outside of the pole tube of the stick.

11 Claims, 4 Drawing Sheets

A
42
44
44

C
28
52
58
E
E
E
58

B
54
46
D
38
40
34
56
46
D
56
38

VII
30
48
50
32
42
38
34
C
B
A
24
28
36
44
42
26
VII
50
48

SKI OR WALKING STICK WITH ADJUSTABLE HANDLE

FIELD OF THE INVENTION

The present invention relates to a stick, such as a ski pole, a walking stick or the like with a pole grip and a pole tube, whose length can be changed, as well as with an adjustment device including a hinge by means of which at least one grip area of the pole grip can be fixed in an angled away position with respect to the pole tube.

BACKGROUND OF THE INVENTION

Ski poles, in particular for alpine skiers, wherein the pole tube is bent in the upper area close to the pole grip, so that when the ski pole is pushed in, it can be held with a natural, unstrained position of the wrist, even when it is pushed in with its tip relatively far ahead, are known.

In order to be able to individually adjust the angle between the ski pole and the pole grip, a ski pole with an adjustment device is known from published German application, DE 44 40 343, by means of which the pole grip can be fixed in an angled away position with respect to the pole tube. Further than that, the length of the ski pole disclosed in the noted publication can be changed, so that it can be adapted to various body sizes and can be shortened to a shorter size for better stowing in a backpack or the like.

However, it is disadvantageous in connection with the known ski pole in that the stowing size, i.e. the minimum length of the ski pole, is considerably larger than with known ski poles whose length can be changed in a telescopic manner, because a lower portion of the ski pole can only be pushed into the upper pole tube as far as the hinge of the adjustment device. Because of this, either the stowing size is increased, or the pole must be divided several times for achieving a shorter stowing size, but this is correspondingly disadvantageous in regard to cost.

SUMMARY OF THE INVENTION

It is an object of the present invention to make an improved pole available, wherein at least one grip area of the pole grip can be fixed in place in an angled away position with respect to the pole tube, but can nevertheless be shortened to a short stowing size.

This object is attained by a pole which has two partial elements which are connected by means of an adjustment device, which adjustment device is arranged outside of the pole tube.

If the pole tube has two partial elements connected via the adjustment device, and the adjustment device is arranged outside of the pole tube, the pole tube can remain hollow on the inside even in the area of the hinge. If the partial elements connected by means of the adjustment device are aligned flush, it is possible to push in a further pole tube in a telescopic manner into the pole tube constituted by the partial elements and the hinge. The pole in accordance with the present invention can then be telescopically pushed together to a stowing size reduced a maximum amount, which corresponds to that of known telescopic ski poles whose grip, however, cannot be angled away with respect to the pole tube. After pulling out the telescopic pole tube elements, at least the grip area of the pole grip can be fixed in an angled away position with respect to the pole tube by means of the adjustment device.

An advantageous arrangement of the hinge with respect to the individual tubes of the pole tube results in that the outer tube has two partial elements and when the two partial elements are aligned in a straight line, the inner tube can be pushed into the upper one of the two partial elements through the hinge.

One of the two partial elements has an extension element which has laterally projecting shaft pins constituting a hinge shaft, which are received by a fork-shaped receiving element provided on the other partial element. With this a simple and stable embodiment of the pole in accordance with the present invention, wherein the pole can be angled away in a plane defined by the shaft pins results.

So that the partial elements of the pole tube connected by means of the adjustment device do not fall apart when loosening the adjustment device for adjusting the angle, it is provided in an embodiment of the present invention that the shaft pins are held by lock washers in the fork, which are snapped into the fork.

By means of the contact surfaces provided, which can be pressed against each other by fastening means, it is possible to achieve great friction between the contact surfaces, so that an angle is not changed once it has been set.

If the contact surfaces additionally have latching elements arranged at angular distances, the set angle remains unchanged even under the greatest loads. Moreover, it is possible to set reproducible angles by means of such latching elements. This is important if the pole must often be shortened to the stowing size and thereafter must be again set to the desired length, and the displacement device must be set to the same angle for use.

A simple measure for achieving the angled away positions is provided by the tube-shaped extension element and/or the tube-shaped receiving element being provided with an axial surface beveled on one side.

If the adjustment device is integrated into the pole grip (claim 8), the appearance of the pole of the present invention can be made visually pleasing, since the adjustment device located outside the pole tube then is moved visually into the background in relation to the pole grip.

The present invention will be explained in detail in what follows by means of an exemplary embodiment, making reference to the drawings.

DESCRIPTION OF THE PREFERRED EMBODIMENTS

Figure 1:
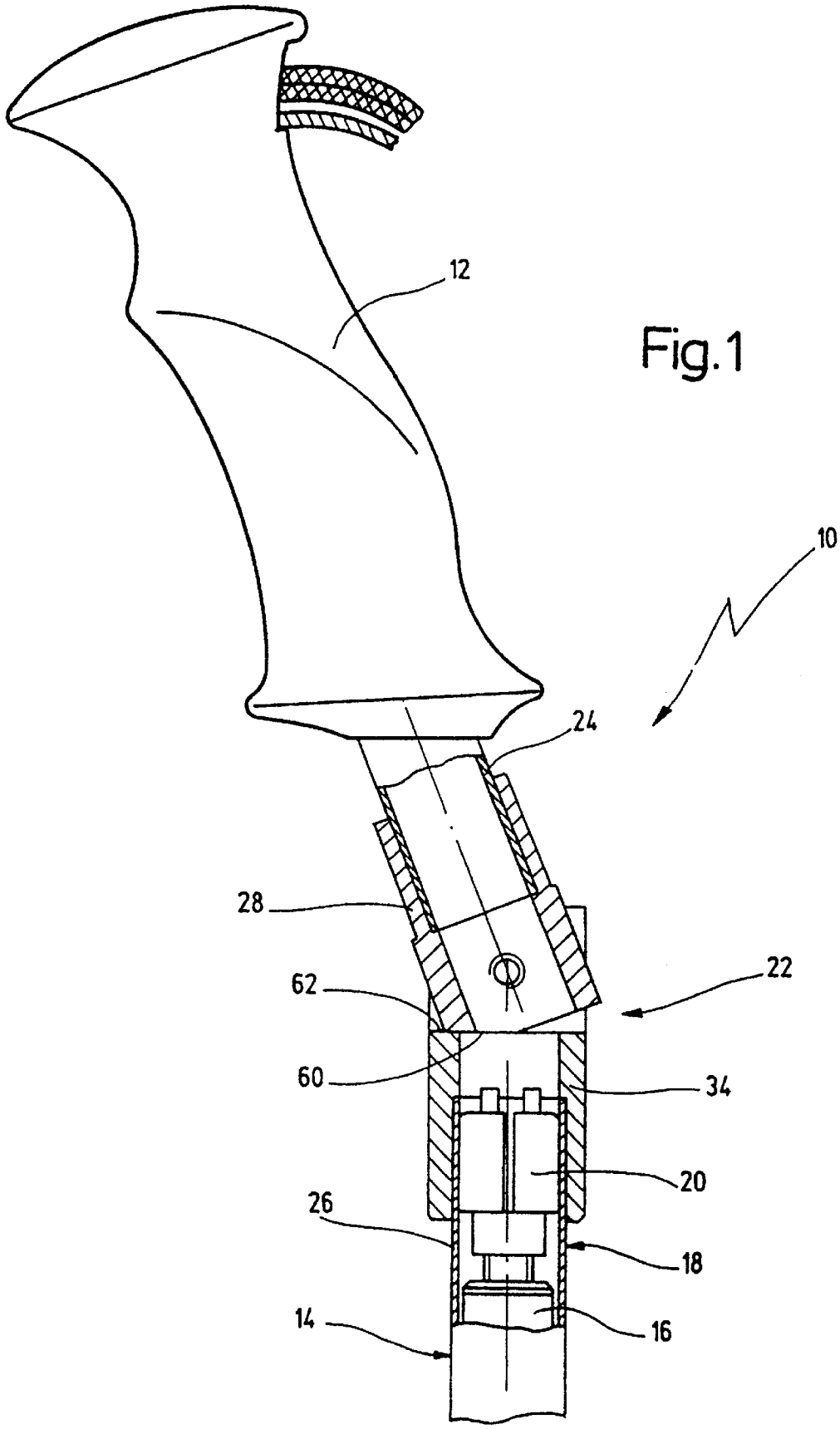
FIG. 1, shows a pole in accordance with the present invention in the angled away state, and partially in cross section.

The present invention will be explained by means of a ski pole 10 represented in the drawings. The ski pole 10 has a pole grip 12 and a pole tube 14. The pole tube 14 is preferably telescopically adjustable in length and has a lower pole tube 16 of lesser diameter (inner tube) which can be pushed into an upper pole tube 18 (outer tube) of increased diameter. The lower pole tube 16 has a spreading element 20, so that when the lower pole tube is turned with respect to the upper one, they can be fixed against each other by means of the spreading element 20.

On its outside, preferably in the vicinity of the pole grip 12, the upper pole tube 18 is connected to an adjustment device 22, which hingedly connects a first partial element 24 of the pole grip 12 with a second partial element 26 of the pole tube 18. The partial elements 24 and 26 can be positioned relative to each other at an angle via a hinge and can be fixed in place in an angled position by means of the adjustment device 22. In this way the pole grip 12 is positioned at an angle with respect to the pole tube 14.

A preferred embodiment of the adjustment device 22 containing the hinge is represented in FIGS. 3 to 7. One of the tube-like partial elements 24, or 26, has a tube-shaped extension element 28, which has laterally projecting shaft pins 30 on opposite sides. The shaft pins 30 are preferably comprise threaded rods 32. The other partial element 26, or 24, has a tube-shaped receiving element 34, which is designed in a manner of a fork, wherein each fork leg 36 and 38 has an elongated hole 40, open toward the top, for receiving the shaft pins 30. A lock washer 42 is pushed on each shaft pin 30, which has two latching pins 44, which engage corresponding recesses 46 in the fork legs 36 and 38. A fastening means 48 has been put on each shaft pin 30, by means of which the adjustment device 22 can be fastened. In the exemplary embodiment represented, the fastening means 48 consist of nuts 50 screwed on the threaded rods 32. Alternatively quick fastening devices, such as are known from bicycles, can be employed as fastening means 48.

Figures 3, 4, 5, 6:
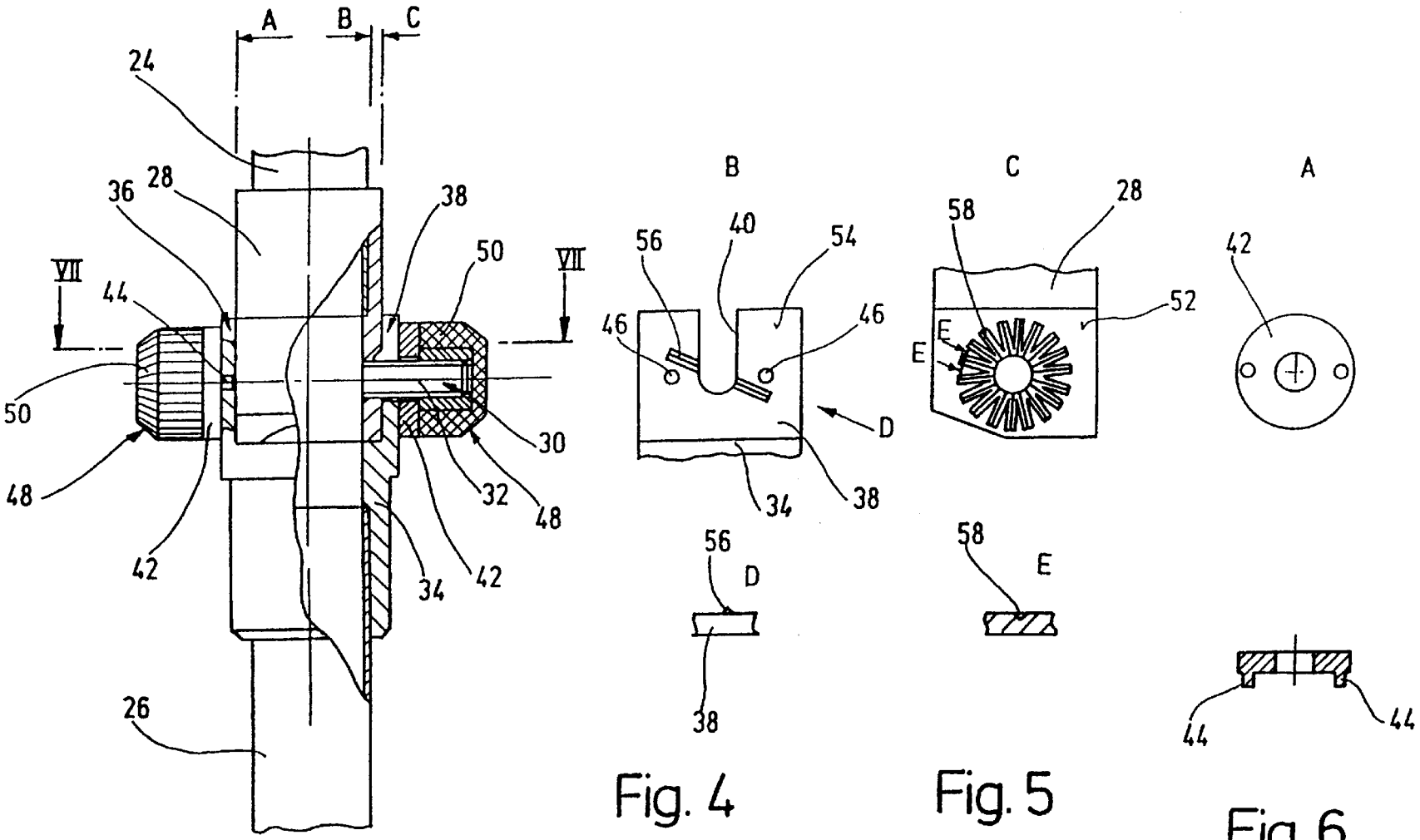
FIG. 3, shows a displacement device of the pole of the present invention, partially in cross section.
FIGS. 4 to 6, show plan views of individual elements of the displacement device.
Figure 7:
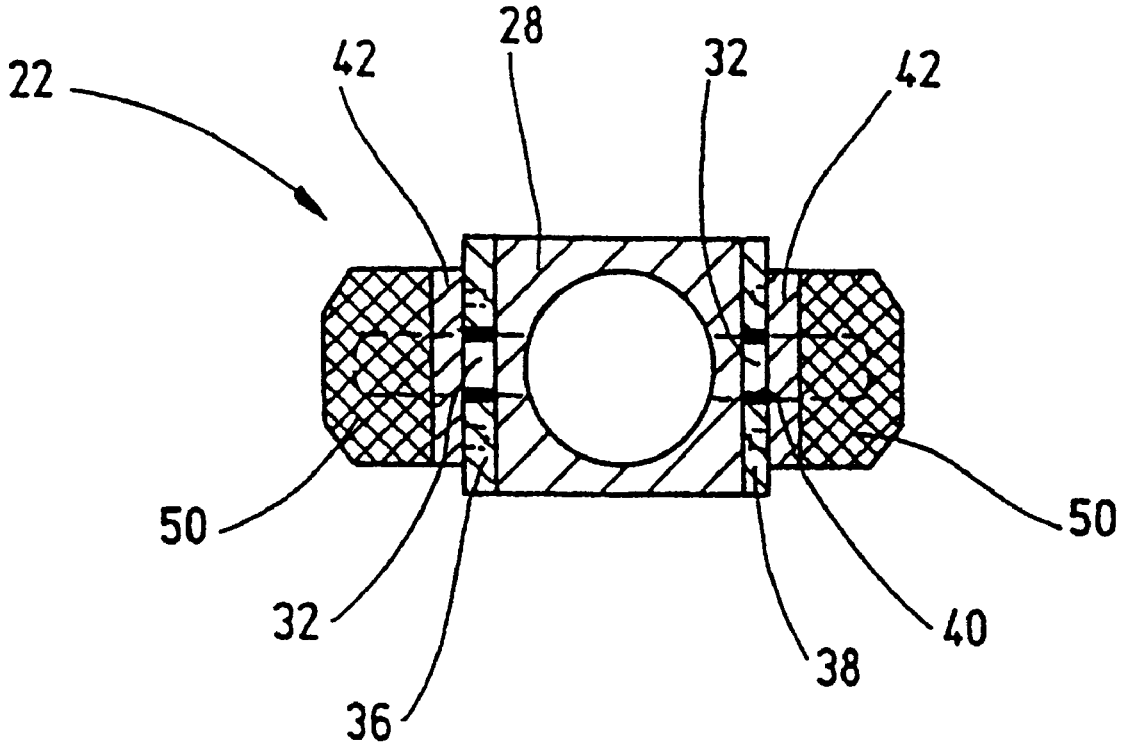
FIG. 7, shows a section along the line VII—VII of FIG. 3.

Contact surfaces 52 of the extension element 28 and contact surfaces 54 of the receiving element 34 are pressed against each other by tightening the nuts 50. The contact surfaces 52 and 54 are represented in FIGS. 4 and 5. In one embodiment of the present invention, for example, the contact surface 54 of the receiving element 34 has latching strips 56, which are shown in the drawings in a plan view at D. The contact surface 52 of the extension element 28 has corresponding latching depressions 58, which are engaged by the latching strips 56 when the contact surfaces 52 and 54 rest against each other. A plurality of latching depressions 58 is represented in FIG. 5, which are arranged at angular distances of approximately 20°. These angular distances are merely given by way of example and are only used for clarification. In this case the pole grip 12 with the partial element 24 of the upper pole tube 18 can then be fixed in placed respectively at angles of a multiple of 20° with respect to the pole tube 14.

In the exemplary embodiment represented, the maximum angle is limited in that an axial lower edge 60 of the extension element 28 comes to rest on an axial upper edge 62 of the receiving element because of the angling. It can possibly be advantageous to design the arc of a circle-shaped lower or upper edge 60, or respectively 62, in such a way, or respectively to bevel it on one side in such a way that angles up to 90° are possible. Then the ski pole in accordance with the present invention could even be used as a crutch in case of an emergency. However, the maximum angle should be at least 30°.

Figure 2:
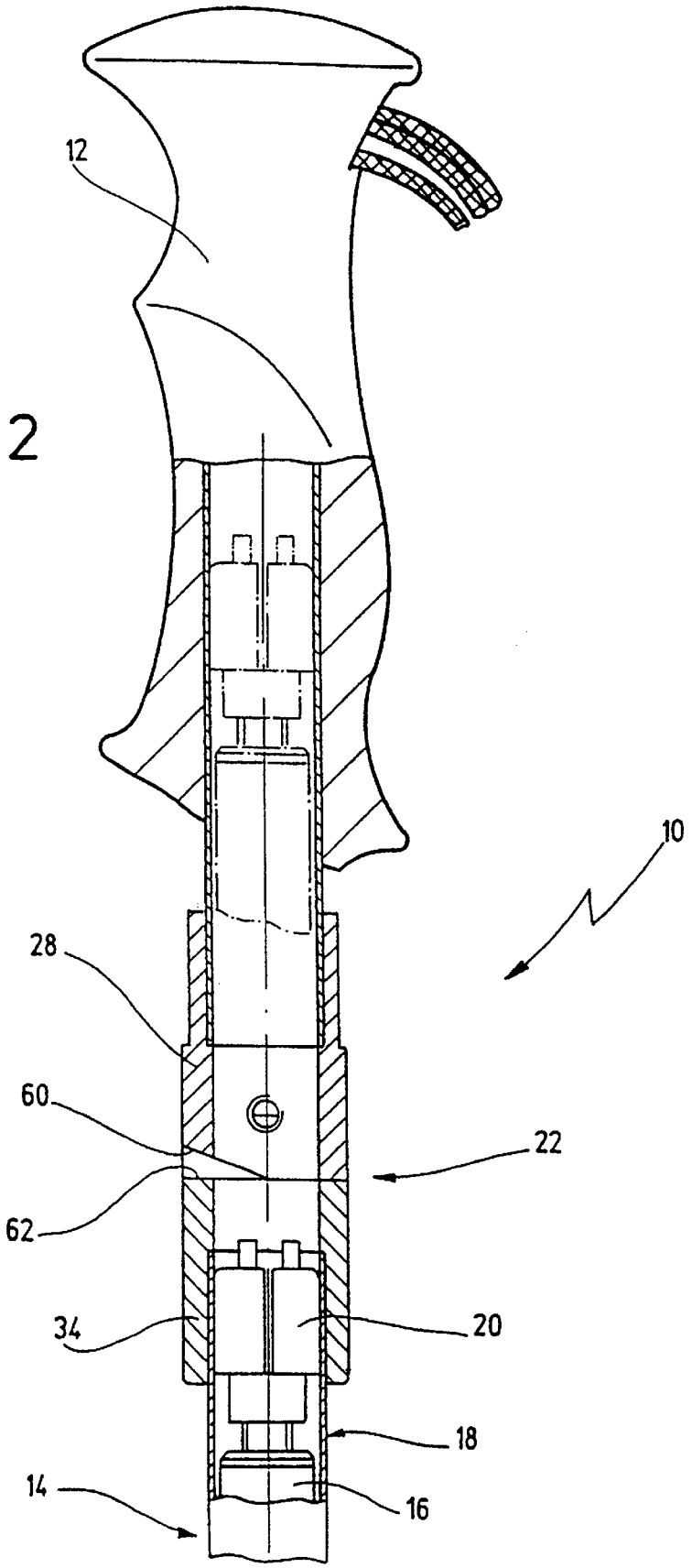
FIG. 2, shows the pole not angled away, and partially in cross section.

To change the angular setting, the nuts 50 must be loosened, because of which the latching strips 56 come out of engagement with the latching depressions 58, so that the partial element 24 of the pole tube 18 can be angled away with respect to the partial element 26. In the process the threaded rod 32 continues to be maintained in the elongated hole 40 by means of the lock washers 42, which are snapped together with the receiving element 34 via the latching strips 44. For pushing the ski pole in accordance with the present invention together, the hollow partial elements 24 and 26, which form part of the hinge, must be aligned (FIG. 2). Then the lower pole tube, or respectively inner tube 16 with the spreading element 20 can be pushed into the area of the outer tube 18 of the ski pole, which other is angled away during use, through the hinge. The stowing size of the ski pole of the invention then corresponds to the stowing size of ski poles without an angled pole grip.

What is claimed is:

1. A stick, comprising one of: a ski pole and a walking stick, further comprising:

a pole tube that is changeable in length comprising two partial elements;

a pole grip mounted to one partial element; and an adjustment device including a hinge, said adjustment device connecting said two partial elements, wherein one of said partial elements being fixed in an angled away position relative to said other one of said partial elements by said adjustment device, wherein said adjustment device is arranged outside of said pole tube and wherein one of said two partial elements includes an outer tube and a telescopically insertable inner tube.

2. The stick as defined in claim 1, wherein when said two partial elements are aligned in a straight line, said inner tube can be pushed from one partial element to the other through the hinge of said adjustment device.

3. The stick as defined in claim 1, wherein said adjustment device includes a fork-shaped receiving element mounted to one partial element, and an extension element mounted to the other partial element, said fork-shaped receiving element and said extension element being mounted to each other by a laterally projecting pin.

4. The stick as defined in claim 2, wherein said adjustment device includes a fork-shaped receiving element mounted to one partial element, and an extension element mounted to the other partial element, said fork-shaped receiving element and said extension element being mounted to each other by a laterally projecting pin.

5. The stick as defined in claim 1, wherein said adjustment device includes a fork-shaped receiving element mounted to one partial element and an extension element mounted to the other partial element, said fork-shaped receiving element and said extension element being mounted to each other by a laterally projecting pin, and wherein said pin comprises two pins held together by lock washers which are snapped together with fork legs.

6. The stick as defined in claim 3, further comprising:

fastening means, wherein said extension element and said fork-shaped receiving element include mutually contacted surfaces which are pressed against each other by said fastening means.

7. The stick as defined in claim 4, further comprising:

fastening means, wherein said extension element and said fork-shaped receiving element include mutually contacted surfaces which are pressed against each other by said fastening means.

8. The stick as defined in claim 3, wherein said contact surfaces have latching elements.

9. The stick as defined in claim 4, wherein said contact surfaces have latching elements.

10. The stick as defined in claim 3, wherein said fork-shaped receiving element and/or said extension element are provided with an axial surface beveled on one side.

11. The stick as defined in claim 1, wherein said adjustment device forms an integral part of said pole tube.

* * * * *